US010741898B2

(12) United States Patent
Liao et al.

(10) Patent No.: US 10,741,898 B2
(45) Date of Patent: Aug. 11, 2020

(54) PHASE SHIFTER HAVING ARC-SHAPED PHASE DELAY LINES ON OPPOSITE SIDES OF A PCB WHICH ARE ADJUSTED BY SLIDABLE PARTS, AN ANTENNA, AND RADIO COMMUNICATIONS DEVICE FORMED THEREFROM

(71) Applicant: HUAWEI TECHNOLOGIES CO., LTD., Shenzhen, Guangdong (CN)

(72) Inventors: Zhiqiang Liao, Shenzhen (CN); Zheng Lin, Shenzhen (CN); Qiyi Lu, Shenzhen (CN); Xionghui Fan, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 7 days.

(21) Appl. No.: 16/023,774

(22) Filed: Jun. 29, 2018

(65) Prior Publication Data

US 2018/0316075 A1 Nov. 1, 2018

Related U.S. Application Data

(63) Continuation of application No. PCT/CN2015/099551, filed on Dec. 29, 2015.

(51) Int. Cl.
*H01P 1/18* (2006.01)
*H01P 9/00* (2006.01)
(Continued)

(52) U.S. Cl.
CPC ..... *H01P 1/184* (2013.01); *H01P 1/062* (2013.01); *H01P 1/183* (2013.01); *H01P 5/12* (2013.01); *H01P 9/006* (2013.01); *H01Q 3/32* (2013.01)

(58) Field of Classification Search
CPC .... H01P 1/184; H01P 1/18; H01P 9/00; H01P 9/006
(Continued)

(56) References Cited

U.S. PATENT DOCUMENTS 6,850,130 B1 2/2005 Gottl et al.
7,233,217 B2 * 6/2007 Phillips et al. ..... H01P 1/184 333/116
(Continued)

FOREIGN PATENT DOCUMENTS

CN 1853314 A 10/2006
CN 102119468 A 7/2011
(Continued)

OTHER PUBLICATIONS

International Search Report and Written Opinion issued in International Application No. PCT/CN2015/099551 dated Sep. 21, 2016, 12 pages.
(Continued)

*Primary Examiner* — Benny T Lee
(74) *Attorney, Agent, or Firm* — Fish & Richardson P.C.

(57) ABSTRACT

The present disclosure relates to a phase shifter, an antenna, and a radio communications device. One example phase shifter includes a cavity, a rotating shaft, a main printed circuit board (PCB), a first slidable part, and a second slidable part. The first slidable part is located on a front side of the main PCB and coupled to the main PCB. The second slidable part is located on a rear side of the main PCB and coupled to the main PCB. The rotating shaft is inserted into the cavity and connected to the first slidable part and the second slidable part. The first arc-shaped phase delay line and the second arc-shaped phase delay line are distributed
(Continued)

on a circle with a center that is the same as a center of the rotating shaft, and are located on an outer side of a primary central coupling section.

13 Claims, 6 Drawing Sheets

(51) Int. Cl.
*H01P 1/06* (2006.01)
*H01P 5/12* (2006.01)
*H01Q 3/32* (2006.01)

(58) Field of Classification Search
USPC ..... 333/161
See application file for complete search history.

(56) References Cited

U.S. PATENT DOCUMENTS

| | | | | |
|---|---|---|---|---|
| 7,298,233 | B2 | 11/2007 | Zimmerman | |
| 2006/0164185 | A1 | 7/2006 | Tae et al. | |
| 2010/0219907 | A1* | 9/2010 | Kim et al. | H01P 1/184 333/161 |
| 2011/0095841 | A1* | 4/2011 | Jung et al. | H01P 1/184 333/100 |
| 2014/0139401 | A1 | 5/2014 | Peng et al. | |

FOREIGN PATENT DOCUMENTS

| | | | |
|---|---|---|---|
| CN | 102263313 | A | 11/2011 |
| CN | 102369631 | B | 12/2013 |
| KR | 101553261 | B1 | 9/2015 |
| WO | 03019720 | A1 | 3/2003 |
| WO | 2010018899 | A1 | 2/2010 |
| WO | 2014141993 | A1 | 9/2014 |

OTHER PUBLICATIONS

Extended European Search Report issued in European Application No. 15911751.4 dated Nov. 26, 2018, 12 pages.

* cited by examiner

PHASE SHIFTER HAVING ARC-SHAPED PHASE DELAY LINES ON OPPOSITE SIDES OF A PCB WHICH ARE ADJUSTED BY SLIDABLE PARTS, AN ANTENNA, AND RADIO COMMUNICATIONS DEVICE FORMED THEREFROM

CROSS-REFERENCE TO RELATED APPLICATIONS

This application is a continuation of International Application No. PCT/CN2015/099551, filed on Dec. 29, 2015, the disclosure of which is hereby incorporated by reference in its entirety.

TECHNICAL FIELD

Embodiments of the present invention relate to the communications field, and in particular, to a phase shifter, an antenna, and a radio communications device.

BACKGROUND

With the increasingly extensive application of mobile communications, there are higher requirements on a communications capacity and communications quality. A remote electrical tilt antenna with an adjustable downtilt can implement good coverage, and reduce mobile communication interference between cells. A phase shifter is an important part of the remote electrical tilt antenna, and a phase adjustment range of the phase shifter has great impact on an effect of standing wave match. In addition, as a quantity of antenna ports in a radio frequency system of a base station increases, a requirement for miniaturization of the phase shifter becomes more urgent.

The phase shifter changes an output phase at an output port by adjusting a length of signal transmission from an input port to the output port. In the prior art, to improve electrical performance of the phase shifter and expand the phase adjustment range, the length of signal transmission from the input port to the output port always needs to be able to increase or decrease within a relatively wide range, and a size of the phase shifter is increased.

SUMMARY OF THE INVENTION

In view of this, embodiments of the present invention provide a phase shifter, an antenna, and a radio communications device, so that a size of the phase shifter can be effectively reduced and the phase shifter has good electrical performance.

According to a first aspect, an embodiment of the present invention provides a phase shifter, including a cavity, a rotating shaft, a main printed circuit board (PCB), a first slidable part, and a second slidable part, where in the cavity, the first slidable part is located on a front side of the main PCB and is coupled to the main PCB, the second slidable part is located on a rear side of the main PCB and is coupled to the main PCB, and the rotating shaft is inserted into the cavity and is connected to the first slidable part and the second slidable part to drive the first slidable part and the second slidable part to rotate relative to the main PCB, where the cavity is configured to form an upper ground layer and a lower ground layer of a strip line of the phase shifter; the main PCB includes a main signal line, a primary central coupling section, a first arc-shaped phase delay line, and a second arc-shaped phase delay line, where the main signal line is configured to receive an input signal and is connected to the primary central coupling section, the primary central coupling section is close to the rotating shaft and is disposed on two sides of a substrate of the main PCB, circuits of the primary central coupling section are in communication with each other, the first arc-shaped phase delay line and the second arc-shaped phase delay line are distributed with a center of the rotating shaft as a center of a circle and are located on an outer side of the primary central coupling section, the first arc-shaped phase delay line has two output ports, and the second arc-shaped phase delay line has two output ports; the first slidable part includes a first secondary central coupling section, a first transmission section, and a first delay line coupling section, where the first secondary central coupling section is close to the rotating shaft and is coupled to the primary central coupling section, and the first delay line coupling section is connected to the first secondary central coupling section by using the first transmission section, so that the first delay line coupling section is coupled to the first arc-shaped phase delay line; and the second slidable part includes a second secondary central coupling section, a second transmission section, and a second delay line coupling section, where the second secondary central coupling section is close to the rotating shaft and is coupled to the primary central coupling section, and the second delay line coupling section is connected to the second secondary central coupling section by using the second transmission section, so that the second delay line coupling section is coupled to the second arc-shaped phase delay line.

In a first possible implementation manner of the first aspect, at least one of the first arc-shaped phase delay line or the second arc-shaped phase delay line is a phase delay line having a superslow wave structure.

With reference to the first aspect or the first possible implementation manner of the first aspect, in a second possible implementation manner of the first aspect, the first arc-shaped phase delay line and the second arc-shaped phase delay line are located on a same side of the rotating shaft.

With reference to any one of the first aspect, the first possible implementation manner of the first aspect, or the second possible implementation manner of the first aspect, in a third possible implementation manner of the first aspect, the phase shifter further includes a zero phase line, and the zero phase line is connected to the main signal line and has a third output port.

With reference to any one of the first aspect, or the first to the third possible implementation manners of the first aspect, in a fourth possible implementation manner of the first aspect, the first slidable part is a metal block or a PCB, and the second slidable part is a metal block or a PCB.

With reference to any one of the first aspect, or the first to the fourth possible implementation manners of the first aspect, in a fifth possible implementation manner of the first aspect, the phase shifter further includes a third arc-shaped phase delay line, and the third arc-shaped phase delay line has two output ports.

With reference to the fifth possible implementation manner of the first aspect, in a sixth possible implementation manner of the first aspect, the first slidable part further includes a third transmission section and a third delay line coupling section, and the third delay line coupling section is connected to the first secondary central coupling section by using the third transmission section, so that the third delay line coupling section is coupled to the third arc-shaped phase delay line.

With reference to the fifth or the sixth possible implementation manner of the first aspect, in a seventh possible implementation manner of the first aspect, the third arc-shaped phase delay line is distributed on another side of the rotating shaft, relative to the first arc-shaped phase delay line.

With reference to any one of the foregoing possible implementation manners of the first aspect, in an eighth possible implementation manner of the first aspect, the output ports are separately connected to radiating elements.

According to a second aspect, an embodiment of the present invention provides an antenna, where the antenna includes the phase shifter according to any one of the possible implementation manners of the first aspect.

According to a third aspect, an embodiment of the present invention provides a radio communications device, where the radio communications device includes an antenna according to any one of the possible implementation manners of the second aspect.

According to a fourth aspect, an embodiment of the present invention provides a radio communications device, where the radio communications device includes the phase shifter according to any one of the possible implementation manners of the first aspect.

Compared with an existing phase shifter, in the phase shifter, the antenna, and the radio communications device that are provided in the embodiments of the present invention, under conditions of a same size and same output ports, two slidable parts respectively couple and transmit signals from a center of a circle to two arc-shaped phase delay lines, the two arc-shaped phase delay lines each have a corresponding transmission section, and a length of each transmission section is longer than that of the existing phase shifter, so that an adjustment range of a length of signal transmission from an input port of the phase shifter to an output port increases, and a phase adjustment range of the output port increases, so as to easily perform standing wave match, thereby improving electrical performance of the phase shifter.

DETAIL DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without undue experimentation shall fall within the protection scope of the present invention.

Figure 1:
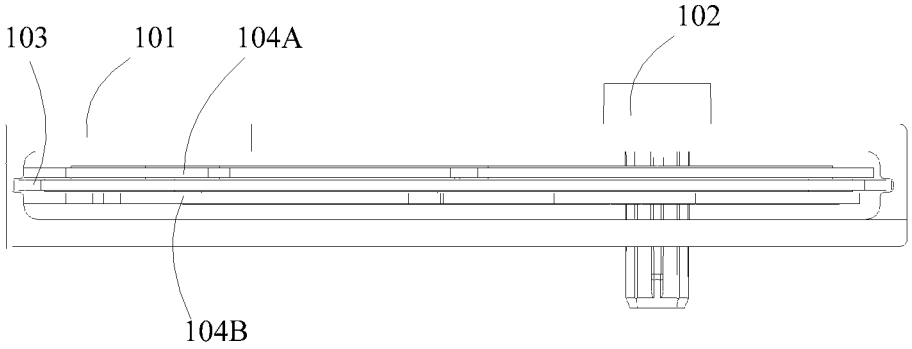
FIG. 1 is a schematic longitudinal-sectional view of a structure of a phase shifter according to an embodiment of the present invention.

FIG. 1 is a schematic longitudinal-sectional view of a structure of a phase shifter according to an embodiment of the present invention. As shown in FIG. 1, the phase shifter includes a cavity 101, a rotating shaft 102, a main printed circuit board (printed circuit board, PCB) 103, a first slidable part 104A, and a second slidable part 104B. The cavity 101 is configured to form an upper ground layer and a lower ground layer of a strip line of the phase shifter. In the cavity 101, the first slidable part 104A and the second slidable part 104B are respectively located on a front side and a rear side of the main PCB 103 and are coupled to the main PCB 103. For example, as shown in FIG. 1, if an upward side of the main PCB 103 is the front side, and correspondingly, a downward side is the rear side, the first slidable part 104A is on the main PCB 103, and the second slidable part 104B is under the main PCB 103. The main PCB 103 may be coupled to the first slidable part 104A and the second slidable part 104B in multiple manners, for example, by using an insulating film or coating materials. The first slidable part 104A and the second slidable part 104B may be PCBs or metal pieces, and this embodiment of the present invention is not limited thereto. The main PCB 103, the first slidable PCB 104A, and the second slidable PCB 104B are disposed in the cavity 101, so that there is no touch point between a signal strip of the phase shifter and the cavity 101, and strip line distribution is formed.

The rotating shaft 102 is inserted into the cavity 101 and is separately connected to the first slidable part 104A and the second slidable part 104B to drive the first slidable part 104A and the second slidable part 104B to rotate relative to the main PCB 103. In an implementation manner, the rotating shaft 102 is inserted into the cavity 101 through a through hole, and passes through the first slidable part 104A, the main PCB 103, and the second slidable part 104B from top to bottom in sequence. The first slidable part 104A and the second slidable part 104B are separately secured to the rotating shaft 102, so that when the rotating shaft 102 rotates, the first slidable part 104A and the second slidable part 104B are driven to rotate relative to the main PCB 103. It should be noted that this is merely an example, and this embodiment of the present invention is not limited thereto.

Figure 2:
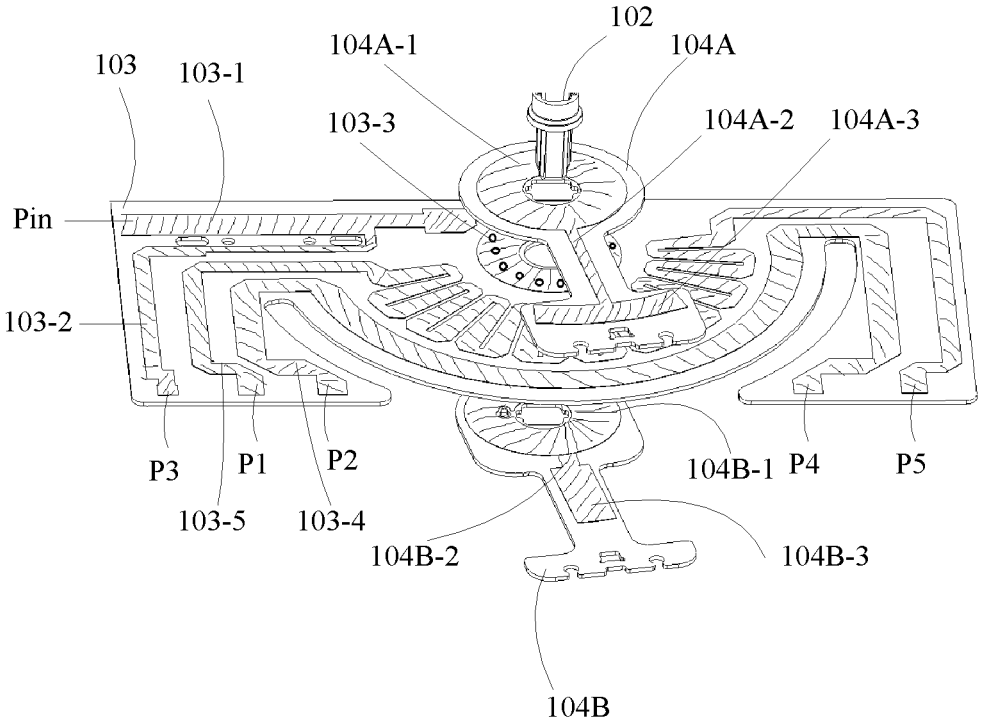
FIG. 2 is a schematic exploded view of an internal structure of a phase shifter according to another embodiment of the present invention.

FIG. 2 is a schematic exploded view of an internal structure of a phase shifter according to another embodiment of the present invention. As shown in this figure, a main PCB 103 includes a main signal line 103-1, a primary central coupling section 103-3, a first arc-shaped phase delay line103-4, and a second arc-shaped phase delay line 103-5.

Figure 4:
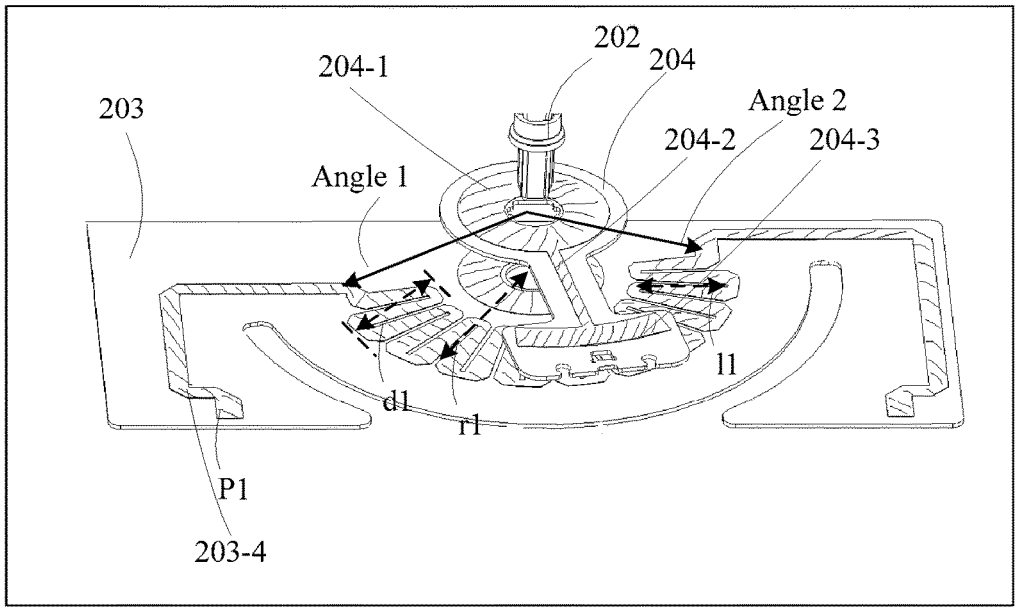
FIG. 4 is a schematic structural diagram of an arc-shaped phase delay line having a superslow wave structure according to another embodiment of the present invention.

The main signal line 103-1 has an input port Pin, is configured to receive an input signal, and is connected to the primary central coupling section 103-3. The primary central coupling section 103-3 is close to a rotating shaft 102 and is disposed on two sides of a substrate of the main PCB 103. Circuits of the primary central coupling section 103-3 on the two sides of the substrate of the main PCB 103 are in communication with each other, as shown in FIG. 4. The primary central coupling section 103-3 may be disposed with a center of the rotating shaft 102 as a center of a circle. The primary central coupling section 103-3 herein may be in a shape of a circular ring surrounding the rotating shaft 102, or may be an arc with the rotating shaft 102 as a center of a circle. The primary central coupling section 103-3 may also be a coupling section that is close to the rotating shaft 102 and that is in another shape. It should be noted that this is merely an example, and the present invention is not limited thereto.

The first arc-shaped phase delay line 103-4 and the second arc-shaped phase delay line 103-5 are distributed with the center of the rotating shaft 102 as a center of a circle, and are located on an outer side of the primary central coupling section 103-3. The first arc-shaped phase delay line 103-4 has two output ports P2 and P4, and the second arc-shaped phase delay line 103-5 has two output ports P1 and P5.

A first slidable part 104A includes a first secondary central coupling section 104A-1, a first transmission section 104A-2, and a first delay line coupling section 104A-3.

The first secondary central coupling section 104A-1 is close to the rotating shaft 102 and is coupled to the primary central coupling section 103-3. For example, the first secondary central coupling section 104A-1 may be disposed with the center of the rotating shaft 102 as a center of a circle. The first secondary central coupling section 104A-1 herein may be in a shape of a circular ring surrounding the rotating shaft 102, or may be an arc with the rotating shaft 102 as a center of a circle. The first secondary central coupling section 104A-1 may be a coupling section that is close to the rotating shaft 102 and that is in another shape. It should be noted that this is merely an example, and this embodiment of the present invention is not limited thereto. Because the main PCB 103 is coupled to the first slidable part 104A, the primary central coupling section 103-3 and the first secondary central coupling section 104A-1 are close to the rotating shaft and are disposed to ensure that the primary central coupling section 103-3 and the first secondary central coupling section 104A-1 can be coupled. The first secondary central coupling section 104A-1 is connected to the first delay line coupling section 104A-3 by using the first transmission section 104A-2, so that the first delay line coupling section 104A-3 is coupled to the first arc-shaped phase delay line 103-4, so as to ensure that a signal can be coupled and transmitted to the first arc-shaped phase delay line 103-4 by using the first delay line coupling section 104A-3. For example, the first secondary central coupling section 104A-1 and the first delay line coupling section 104A-3 are respectively located on two ends of the first transmission section 104A-2. The first transmission section 104A-2 may be in a shape of a straight line segment, or may be in a shape of another fold line segment or a curve segment, provided that a linear distance between the two ends of the first transmission section 104A-2 implements a coupled connection between the first delay line coupling section 104A-3 and the first arc-shaped phase delay line 103-4. In an embodiment of the present invention, a difference between a radius of the first arc-shaped phase delay line 103-4 and a radius of the first secondary central coupling section 104A-1 matches the linear distance between the two ends of the first transmission section 104A-2. It should be noted that this is merely an example, and the present invention is not limited thereto. Therefore, the first slidable part 104A may be configured to couple and transmit a signal to the first arc-shaped phase delay line 103-4.

A second slidable part 104B includes a second secondary central coupling section 104B-1, a second transmission section 104B-2, and a second delay line coupling section 104B-3.

The second secondary central coupling section 104B-1 is close to the rotating shaft 102 and is coupled to the primary central coupling section 103-3. An implementation manner herein is similar to that of the first secondary central coupling section 104A-1, and details are not described herein. Because the main PCB 103 is coupled to the second slidable part 104B, the primary central coupling section 103-3 and the second secondary central coupling section 104B-1 are close to the rotating shaft and are disposed to ensure that the primary central coupling section 103-3 and the second secondary central coupling section 104B-1 can be coupled. The second secondary central coupling section 104B-1 is connected to the second delay line coupling section 104B-3 by using the second transmission section 104B-2, so that the second delay line coupling section 104B-3 is coupled to the second arc-shaped phase delay line 103-5, so as to ensure that a signal can be coupled and transmitted to the second arc-shaped phase delay line 103-5 by using the second delay line coupling section 104B-3. An implementation manner of the second slidable part 104B is similar to that of the first slidable part 104A. Refer to the foregoing description of each part of the first slidable part 104A, and details are not described herein. A difference lies in that the second delay line coupling section 104B-3 of the second slidable part 104B is coupled to the second arc-shaped phase delay line 103-5, and the second slidable part 104B is configured to couple and transmit a signal to the second arc-shaped phase delay line 103-5.

The signal is input from the input port Pin, and transmitted to the primary coupling section 103-3 through the main signal line 103-1. The signal is divided into two signals, and the signals are respectively coupled and transmitted to the first arc-shaped phase delay line 103-4 and the second arc-shaped phase delay line 103-5 by using the first slidable part 104A and the second slidable part 104B. Using the first slidable part 104A as an example, after the signal is divided into two signals, one signal is coupled and transmitted to the first secondary central coupling section 104A-1 to which the primary coupling section 103-3 is coupled, is transmitted to the first delay line coupling section 104A-3 by using the first transmission section 104A-2, and then, is coupled and transmitted to the first arc-shaped phase delay line 103-4 coupled to the first delay line coupling section 104A-3. A transmission method of the other signal transmitted by using the second slidable part 104B is similar to the foregoing transmission method, and details are not described herein.

When the rotating shaft 102 drives the first slidable part 104A and the second slidable part 104B to rotate relative to the main PCB 103, a length of signal transmission from the input port Pin to each output port changes, so that a phase of an output signal from each output port increases or decreases correspondingly. Using the two output ports of the first arc-shaped phase delay line as an example, as shown in FIG. 2, when the first slidable part 104A rotates from the left to the right, for example, rotates from an angle 1 to an angle 2, as shown in FIG. 4, a length of signal transmission from the input port Pin to the output port P1 increases, and a length of signal transmission from the input port Pin to the output port P5 decreases, so that a phase of an output signal at the output port P5 decreases and a phase of an output signal at the output port P5 increases.

Compared with an existing phase shifter, in the phase shifter provided in this embodiment of the present invention, under conditions of a same size and same output ports, two slidable parts respectively couple and transmit signals from a center of a circle to two arc-shaped phase delay lines, the two arc-shaped phase delay lines each have a corresponding transmission section, and a length of each transmission section is longer than that of the existing phase shifter, so as to easily perform standing wave match. In addition, an adjustment range of a length of signal transmission from an input port of the phase shifter to an output port increases, so that a phase adjustment range of the phase shifter increases, thereby improving electrical performance of the phase shifter.

Figure 3:
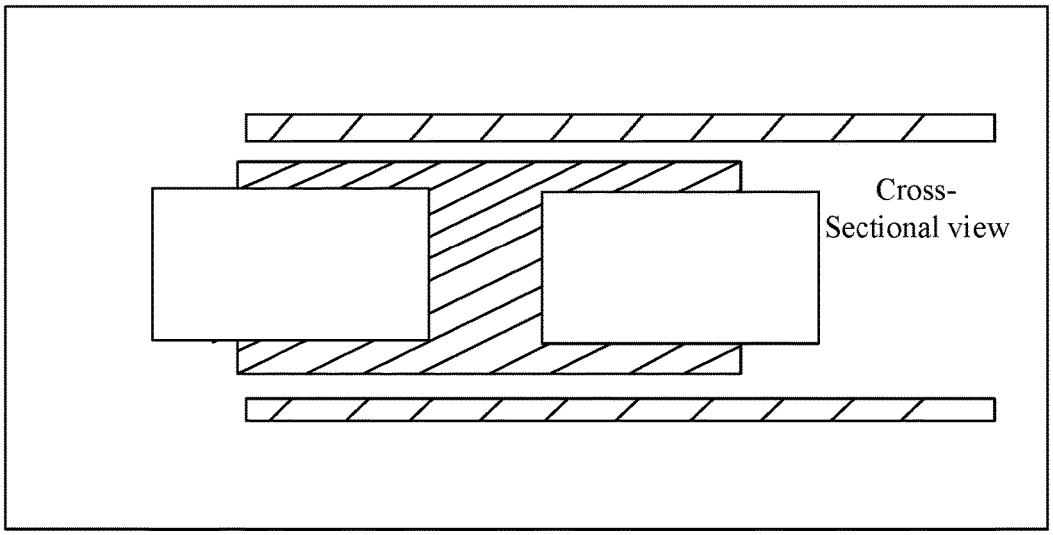
FIG. 3 is a cross-sectional view of a primary central coupling section of a phase shifter according to another embodiment of the present invention.

Optionally, the main PCB 103 may further include a zero phase line 103-2, where the zero phase line 103-2 is connected to the main signal line, and an output phase of an output port P3 of the zero phase line 103-2 is constant. The zero phase line 103-2 is configured to output a zero phase, which may form arithmetic phases with other output phases of other output ports. For example, a phase at the output port P3 is 0, and by means of rotation of the rotating shaft 102, output phases at output ports P1, P2, P3, P4, and P5 respectively are −2Φ, −1Φ, 0, 1Φ, and 2Φ, where Φ is a phase angle. FIG. 3 shows a cross-sectional view of a primary central coupling section of a phase shifter according to another embodiment of the present invention.

Figure 5:
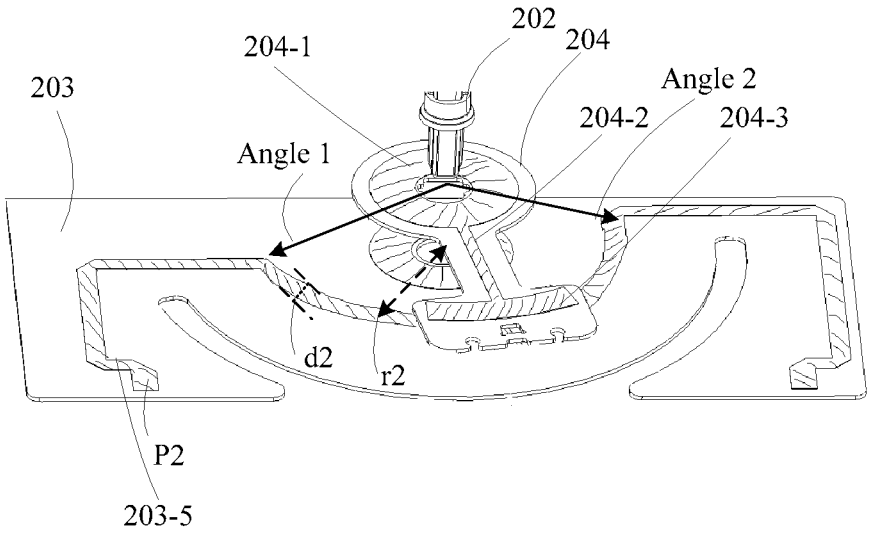
FIG. 5 is a schematic structural diagram of an arc-shaped phase delay line structure according to another embodiment of this present invention.

FIG. 4 is a schematic structural diagram of an arc-shaped phase delay line having a superslow wave structure according to another embodiment of the present invention, and FIG. 5 is a schematic structural diagram of an arc-shaped phase delay line structure according to another embodiment of the present invention. As shown in FIG. 4 and FIG. 5, a center of a rotating shaft 202 is used as a center of a circle, and the arc-shaped phase delay lines are distributed with the center of the rotating shaft 202 as the center of the circle. Referring to FIG. 4, an arc-shaped phase delay line 203-4, included in a main PCB 203, having a superslow wave structure is of a snake shape, a depth of a snake-shaped gap is l1, a radius relative to an axis of the rotating shaft 202 is r1, and a difference between an inner diameter and an outer diameter of the arc-shaped phase delay line, that is, a width, is d1. Referring to FIG. 5, a radius, of an arc-shaped phase delay line 203-5 structure included in a main PCB 203, relative to an axis of the rotating shaft 202 is r2, and a difference between an inner diameter and an outer diameter of the arc-shaped phase delay line, that is, a width of the arc-shaped phase delay line, is d2. The phase delay line having the superslow wave structure is generally of a snake shape. Under same impedance, in general, the width d1 of the arc-shaped phase delay line having the superslow wave structure is greater than d2 of the arc-shaped phase delay line structure. For example, d1 is greater than 2*d2, and the depth l1 of the snake-shaped gap may range from 0.6 to 0.9 times d1. It should be noted that this is merely an example, and this embodiment of the present invention is not limited thereto.

Figure 6:
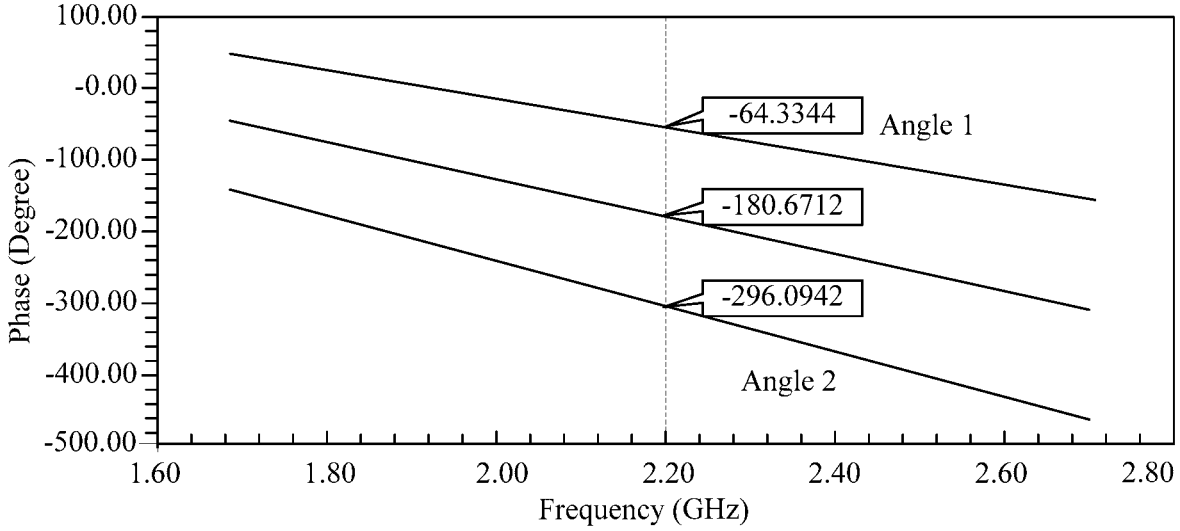
FIG. 6 is a diagram showing a change of an output phase of an arc-shaped phase delay line having a superslow wave structure according to another embodiment of the present invention.
Figure 7:
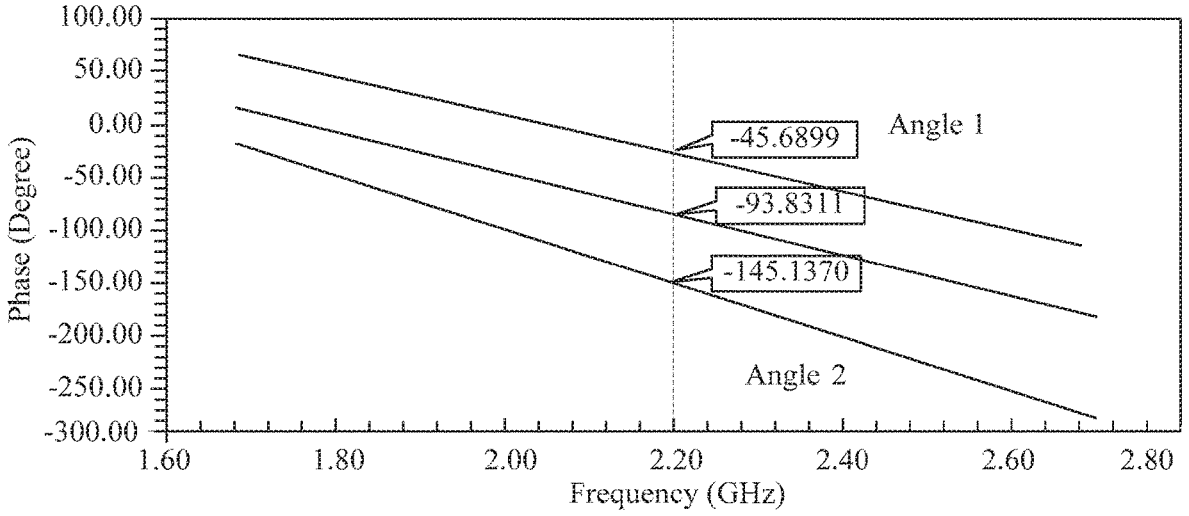
FIG. 7 is a diagram showing a change of an output phase of an arc-shaped phase delay line structure according to another embodiment of the present invention.

In FIG. 4 and FIG. 5, a slidable part 204 includes a secondary central coupling section 204-1, a transmission section 204-2, and a delay line coupling section 204-3, so that a signal is coupled from a primary coupling section 203-3 close to the rotating shaft 202 to an arc-shaped phase delay line and is output to an output port. When r1=r2, angles 1 in FIG. 4 and FIG. 5 are the same, and angles 2 in FIG. 4 and FIG. 5 are the same as well. When the slidable part 204 swings from the angle 1 to the angle 2 along the axis, a phase change of an output port P1 (FIG. 4) of the arc-shaped phase delay line 203-4 (FIG. 4) having the superslow wave structure is shown in FIG. 6, and a phase change of an output port P2 (FIG. 5) of the arc-shaped phase delay line 203-5 (FIG. 5) structure is shown in FIG. 7. As shown in FIGS. 6 and 7, vertical axes represent a phase with units of degree, and horizontal axes represent a frequency with units of GHz. For example, when the frequency is 2.2 GHz, for the arc-shaped phase delay line 203-4 as depicted in FIG. 4 having the superslow wave structure, an output phase at the angle 1 is −64.3344 degrees, an output phase at an angle between the angle 1 and the angle 2 is −180.6712, and an output phase at the angle 2 is −296.0942 degrees as depicted in FIG. 6; for the arc-shaped phase delay line 203-5 structure, an output phase at the angle 1 is −45.6899 degrees, an output angle 2 is −145.1370 degrees as depicted in FIG. 7. As can be seen from FIG. 6 and FIG. 7, under a same frequency and a same angle, an output phase of the arc-shaped phase delay line having the superslow wave structure is less than an output phase of the arc-shaped delay line structure. When the slidable part 204 swings from the angle 1 to the angle 2 as shown in FIG. 2, phase shifts of the two arc-shaped phase delay lines are compared. The phase shift herein refers to an absolute value of a difference between the output phases at the angle 1 and the angle 2, and may represent a phase adjustment range. For the arc-shaped phase delay line 203-4 (FIG. 4) having the superslow wave structure, the phase shift is 231.7598 degrees (an absolute value of a difference between −64.3344 degrees and −296.0942 degrees),and for the arc-shaped phase delay line 203-5 (FIG. 4) structure, the phase shift is 99.4471 degrees (an absolute value if a difference between −45.6899 degrees and −145.1370. As can be seen, the phase adjustment range of the arc-shaped phase delay line having the superslow wave structure is far greater than that of the arc-shaped phase delay line structure. It should be noted that the data herein is merely an example, and this embodiment of the present invention is not limited thereto.

In an embodiment of the present invention, at least one of the first arc-shaped phase delay line or the second arc-shaped phase delay line is an arc-shaped phase delay line having a superslow wave structure. As shown in FIG. 2, the first arc-shaped phase delay line 103-4 is an arc-shaped phase delay line structure, and the second arc-shaped phase delay line 103-5 is an arc-shaped phase delay line having a superslow wave structure. Alternatively, the first arc-shaped phase delay line 103-4 is an arc-shaped phase delay line having a superslow wave structure, and the second arc-shaped phase delay line is an arc-shaped phase delay line structure, or the both are arc-shaped phase delay lines having a superslow wave structure. It should be noted that this is merely an example, and this embodiment of the present invention is not limited thereto. Under a condition of a same radius, that is, a same size, the phase shift of the phase delay line having the superslow wave structure may increase to more than two times the shift phase of the phase delay line structure, so that the phase adjustment range of the phase shifter may increase to more than two times.

Figure 8:
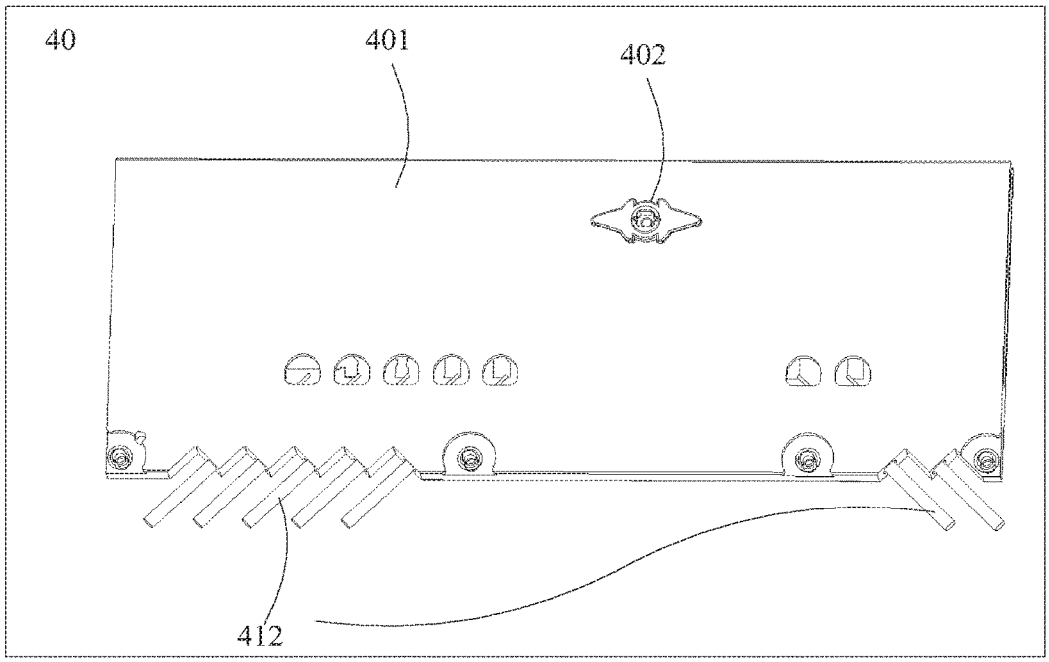
FIG. 8 is a diagram of an external structure of a phase shifter according to another embodiment of the present invention.
Figure 9:
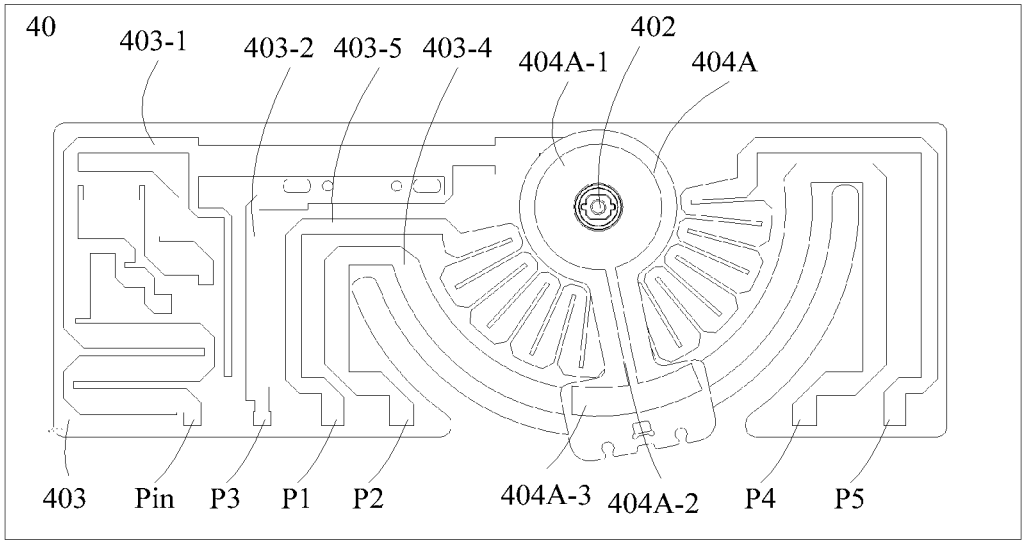
FIG. 9 is a schematic plan view of an internal structure of a front side of a main PCB of a phase shifter according to another embodiment of the present invention.
Figure 10:
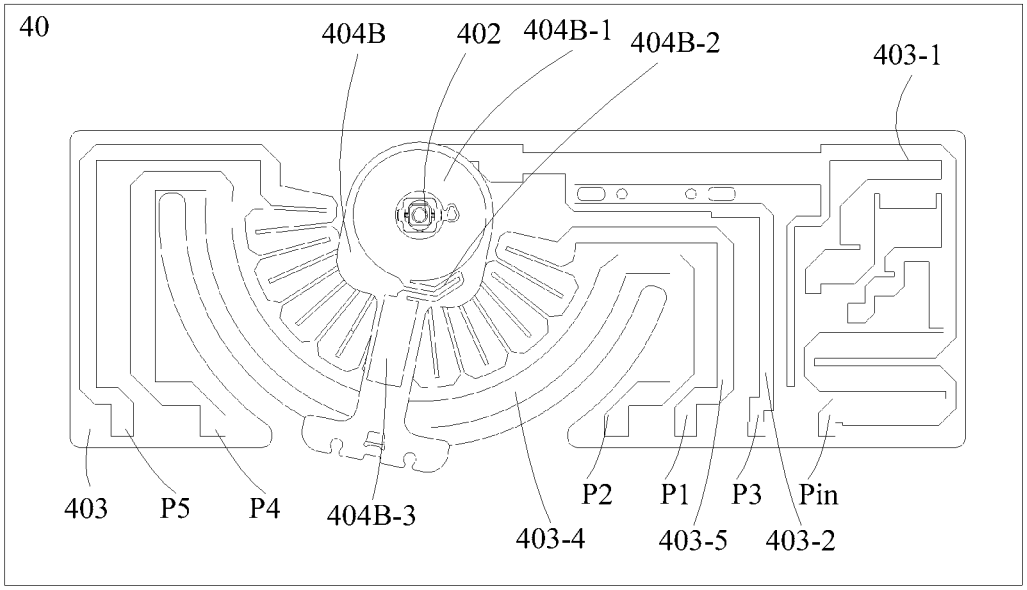
FIG. 10 is a schematic plan view of an internal structure of a rear side of a main PCB of a phase shifter according to another embodiment of the present invention.

FIG. 8 is an external structural diagram of a phase shifter according to another embodiment of the present invention, and the phase shifter is a lumped 6-port phase shifter. FIG. 9 is a schematic plan view of an internal structure of a front side of a main PCB of the phase shifter provided in this embodiment, and FIG. 10 is a schematic plan view of an internal structure of a rear side of the main PCB of the phase shifter provided in this embodiment. Referring to FIG. 8, FIG. 9, and FIG. 10, the phase shifter 40 includes a cavity 401 (FIG. 8), a rotating shaft 402, a main PCB 403, a first slidable part 404A (FIG. 9), and a second slidable part 404B (FIG. 10).

A front side and a rear side of the main PCB 403 are respectively coupled to the first slidable part 404A and the second slidable part 404B, and are locked into slots of the cavity 401, so that there is no touch point between a signal strip of the phase shifter and the cavity 401, thereby forming strip line distribution.

The rotating shaft 402 is inserted into the cavity 401 and is separately connected to the first slidable part 404A and the second slidable part 404B to drive the first slidable part 404A and the second slidable part 404B to rotate relative to the main PCB 403.

The main PCB 403 includes a main signal line 403-1, a zero phase line 403-2, a primary central coupling section, a first arc-shaped phase delay line 403-4, and a second arc-shaped phase delay line 403-5. The main signal line 403-1 has an input port Pin, and the input port is configured to receive an input signal and is connected to the primary central coupling section. The first arc-shaped phase delay line 403-4 and the second arc-shaped phase delay line 403-5 are distributed with a center of the rotating shaft 402 as a center of a circle, are located on an outer side of the primary central coupling section, and are located on a same side of the rotating shaft 402. The first arc-shaped phase delay line 403-4 has two output ports P1 and P5, and the second arc-shaped phase delay line 403-5 has two output ports P2 and P4. The zero phase line 403-2 is connected to the main signal line 403-1, and has an output port P3.

The first slidable part 404A includes a first secondary central coupling section 404A-1, a first transmission section 404A-2, and a first delay line coupling section 404A-3 as shown in FIG. 9. The first slidable part 404A is configured to couple and transmit a signal to the first arc-shaped phase delay line 403-4.

The second slidable part 404B includes a second secondary central coupling section 404B-1, a second transmission section 404B-2, and a second delay line coupling section 404B-3 as shown in FIG. 10. The second slidable part 404B is configured to couple and transmit a signal to the second arc-shaped phase delay line 403-5.

The phase shifter 40 may further include a coaxial line 412 (FIG. 8), configured to be electrically connected to various input ports and output ports to output signals, so that the output ports are connected to radiating elements, and signals can be effectively output to generate a directivity pattern.

When a signal is input from the input port Pin, a part of energy is output from the output port P3 of the zero phase line 403-2, forming a zero phase, and the other part of energy is divided into two parts by using the primary central coupling section. The two parts are respectively coupled and transmitted to the first arc-shaped phase delay line 403-4 and the second arc-shaped phase delay line 403-5 by using the first slidable part 404A and the second slidable part 404B, and are output from the output ports P1, P2, P4, and P5.

When the first slidable part 404A and the second slidable part 404B are driven by the rotating shaft 402 to rotate around the center of the rotating shaft 402, lengths of signal transmission from the input port Pin to different output ports P1, P2, P4, and P5 change, so that phase values of the foregoing output ports change, and a phase shift action is generated.

It should be noted that, for a structure and a connection manner in this embodiment of the present invention, refer to the related records of the foregoing embodiments, and implementation principles and technical effects thereof are similar, and details are not described herein.

Compared with an existing phase shifter, in the phase shifter provided in this embodiment of the present invention, under conditions of a same size and same output ports, two slidable parts respectively couple and transmit signals from a center of a circle to two arc-shaped phase delay lines, the two arc-shaped phase delay lines each have a corresponding transmission section, and a length of each transmission section is longer than that of the existing phase shifter, so as to easily perform standing wave match. In addition, an adjustment range of a length of signal transmission from an input port of the phase shifter to an output port increases, so that a phase adjustment range of the phase shifter increases, thereby improving electrical performance of the phase shifter.

Further, to increase a quantity of output ports, on the basis of the foregoing embodiment, another arc-shaped phase delay line may be further added on the main PCB of the phase shifter, and each of the arc-shaped phase delay lines has two output ports. To couple and transmit a signal from a center of the rotating shaft to the arc-shaped phase delay lines, the arc-shaped phase delay lines may be distributed on a same side or two sides with the center of the rotating shaft as a center of a circle. Correspondingly, a secondary central coupling section, a transmission section, and a delay line coupling section need to be added to the first slidable part or the second slidable part, so that a signal is coupled and transmitted from the center of the circle to the new arc-shaped phase delay line for output.

Figure 11:
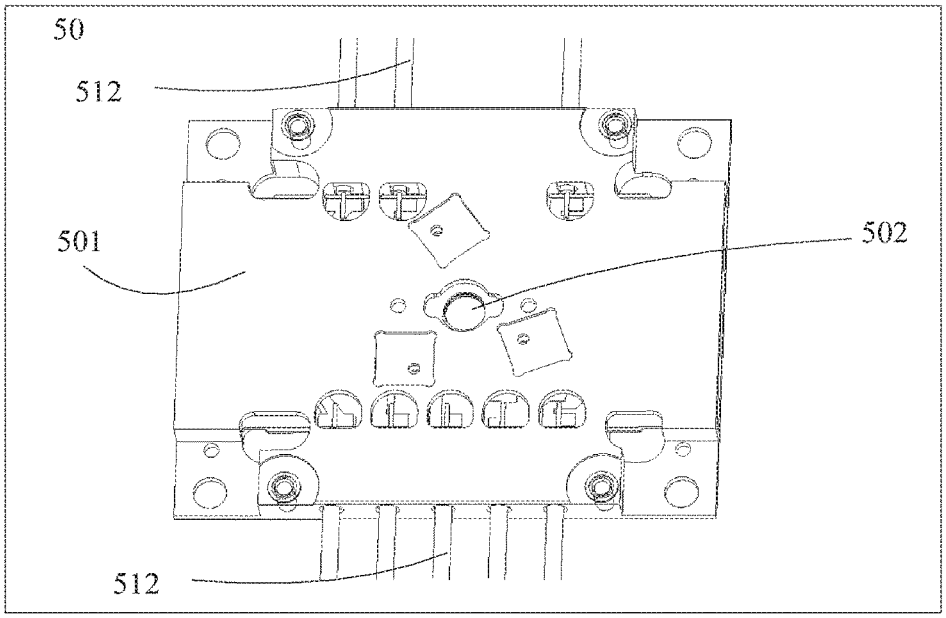
FIG. 11 is a diagram of an external structure of a phase shifter according to another embodiment of the present invention.
Figure 12:
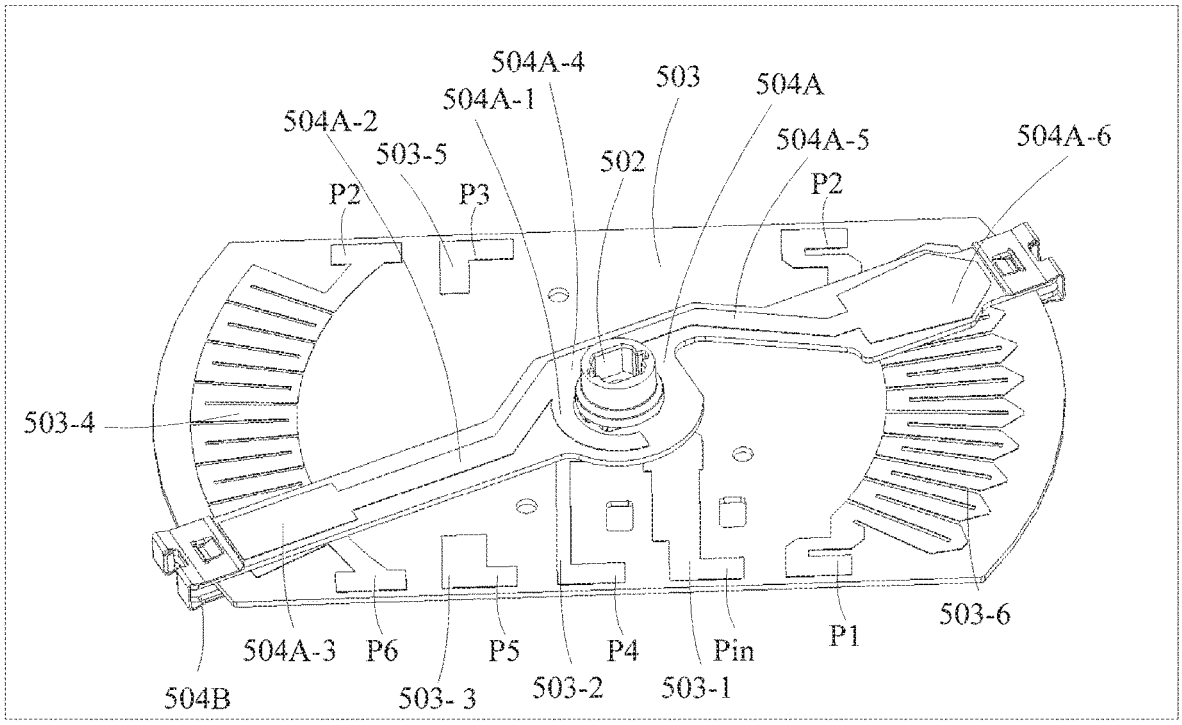
FIG. 12 is a schematic plan view of an internal structure of a front side of a main PCB of a phase shifter according to another embodiment of the present invention.

FIG. 11 is a diagram of an external structure of a phase shifter according to another embodiment of the present invention, where the phase shifter has eight ports. FIG. 12 is a schematic plan view of an internal structure of a front side of a main PCB of the phase shifter provided in this embodiment. For a schematic plan view of an internal structure of a rear side of the main PCB of the phase shifter, refer to the foregoing embodiment, and details are not described herein. Referring to FIG. 11 and FIG. 12, the phase shifter 50 (FIG. 11) includes a cavity 501 (FIG. 11), a rotating shaft 502, a main PCB 503 (FIG. 12), a first slidable part 504A (FIG. 12), and a second slidable part 504B (FIG. 12). As shown in FIG. 12, the main PCB 503 includes a main signal line 503-1 having an input port Pin, a zero phase line 503-2 having an output port P4, a primary central coupling section, a first arc-shaped phase delay line 503-4 having two output ports P2 and P6, and a second arc-shaped phase delay line 503-5 having an output port P3. The first slidable part 504A includes a first secondary central coupling section 504A-1, a first transmission section 504A-2, and a first delay line coupling section 504A-3. The first slidable part 504A is configured to couple and transmit a signal to the first arc-shaped phase delay line 503-4. The second slidable part 504B includes a second secondary central coupling section, a second transmission section, and a second delay line coupling section. The second slidable part 504B is configured to couple and transmit a signal to the second arc-shaped phase delay line 503-5. The second arc-shaped phase delay line 503-5 and the second slidable part 504B are located on a rear side of the main PCB. For a structure and deployment thereof, refer to the foregoing embodiments, and details are not described herein.

The main PCB 503 further includes a third arc-shaped phase delay line 503-6. The third arc-shaped phase delay line 503-6 is distributed with a center of the rotating shaft 502 as a center of a circle, is located on an outer side of the primary central coupling section, and is distributed on another side of the rotating shaft 502, relative to the first arc-shaped phase delay line 503-3 having an output port P5. A radius of the third arc-shaped phase delay line 503-6 may be the same as that of the first arc-shaped phase delay line 503-4, or may be different from that of the first arc-shaped phase delay line 503-4. The third arc-shaped phase delay line 503-6 may have a superslow wave structure, or may have a conventional arc-shaped structure. It should be noted that this is merely an example, and this embodiment of the present invention is not limited thereto. The third arc-shaped phase delay line 503-6 has two output ports P1 and P2.

Correspondingly, the first slidable part 504A further includes a third secondary central coupling section 504A-4, a third transmission section 504A-5, and a third delay line coupling section 504A-6. The third secondary central coupling section 504A-4 is close to the rotating shaft 502, is coupled to the primary central coupling section, and may be in a shape of a circular ring surrounding the rotating shaft 502, or may be an arc with the rotating shaft 502 as a center of a circle. The third secondary central coupling section 504A-4 may be a coupling section that is close to the rotating shaft 502 and that is in another shape. Further, the third secondary central coupling section 504A-4 may be connected to the first secondary central coupling section 504A-1, to form one secondary central coupling section, or may be separated from the first secondary central coupling section 504A-1. It should be noted that this is merely an example, and this embodiment of the present invention is not limited thereto.

The third secondary central coupling section 504A-4 is connected to the third delay line coupling section 504A-6 by using the third transmission section 504A-5, so that the third delay line coupling section 504A-6 is coupled to the third arc-shaped phase delay line 503-6, so as to ensure that a signal can be coupled and transmitted to the third arc-shaped phase delay line 503-6 by using the third delay line coupling section 504A-6.

The phase shifter 50 may further include a coaxial line 512 (FIG. 11), configured to be electrically connected to various input ports and output ports to output signals, so that the output ports are connected to radiating elements, and signals can be effectively output to generate a directivity pattern.

It should be noted that, for a structure and a connection manner in this embodiment of the present invention, refer to the related records of the foregoing embodiments, and implementation principles and technical effects thereof are similar, and details are not described herein.

The phase shifter provided in this embodiment of the present invention has the advantages of the phase shifter in the foregoing embodiments. In addition, an arc-shaped phase delay line is added on another side of a rotating shaft, so that a quantity of output ports of the phase shifter increases on a basis of the foregoing embodiments.

An embodiment of the present invention further provides an antenna. For a phase shifter included in the antenna in this embodiment, refer to the foregoing description, and details are not described in this embodiment. The antenna may be applied to a radio communications device.

Correspondingly, an embodiment of the present invention further provides a radio communications device. For an antenna included in the radio communications device in this embodiment, refer to the foregoing embodiments.

An embodiment of the present invention further provides a radio communications device. For a phase shifter included in the radio communications device in this embodiment, refer to the foregoing embodiments, and details are not described in this embodiment.

The radio communications device herein may be a base station, or may be a terminal device. This embodiment of the present invention is not limited thereto.

In the several embodiments provided in this application, it should be understood that the disclosed device and method may be implemented in other manners. For example, the device embodiments described above are merely examples.

By means of descriptions of the foregoing embodiments, a practitioner skilled in the art may clearly understand that the present invention may be implemented by hardware, firmware or a combination thereof.

In summary, what is described above is merely examples of embodiments of the technical solutions of the present invention, but is not intended to limit the protection scope of the present invention. Any modification, equivalent replacement, or improvement made without departing from the spirit and principle of the present invention shall fall within the protection scope of the present invention.

What is claimed is:

1. A radio communications device, comprising a phase shifter, wherein:

the phase shifter comprising a cavity, a rotating shaft, a main printed circuit board (PCB), a first slidable part, and a second slidable part, wherein in the cavity, the first slidable part is located on a front side of the main PCB and is coupled to the main PCB, the second slidable part is located on a rear side of the main PCB and is coupled to the main PCB, and the rotating shaft is inserted into the cavity and is connected to the first slidable part and the second slidable part to drive the first slidable part and the second slidable part to rotate relative to the main PCB, and wherein:

the main PCB comprises a main signal line, a primary central coupling section, a first arc-shaped phase delay line, and a second arc-shaped phase delay line, wherein:

the main signal line is configured to receive an input signal and is connected to the primary central coupling section, the primary central coupling section is close to the rotating shaft and is disposed on two sides of a substrate of the main PCB, the first arc-shaped phase delay line and the second arc-shaped phase delay line are distributed on a circle with a center that is the same as a center of the rotating shaft and are located on an outer side of the primary central coupling section, the first arc-shaped phase delay line has two output ports, and the second arc-shaped phase delay line has two output ports;

the first slidable part comprises a first secondary central coupling section, a first transmission section, and a first delay line coupling section, wherein:

the first secondary central coupling section is close to the rotating shaft and is coupled to the primary central coupling section, the first delay line coupling section is connected to the first secondary central coupling section using the first transmission section, and the first delay line coupling section is coupled to the first arc-shaped phase delay line; and the second slidable part comprises a second secondary central coupling section, a second transmission section, and a second delay line coupling section, wherein:

the second secondary central coupling section is close to the rotating shaft and is coupled to the primary central coupling section, the second delay line coupling section is connected to the second secondary central coupling section using the second transmission section, and the second delay line coupling section is coupled to the second arc-shaped phase delay line.

2. A phase shifter, comprising:

a cavity;

a rotating shaft;

a main printed circuit board (PCB);

a first slidable part; and a second slidable part, wherein in the cavity, the first slidable part is located on a front side of the main PCB and is coupled to the main PCB, the second slidable part is located on a rear side of the main PCB and is coupled to the main PCB, and the rotating shaft is inserted into the cavity and is connected to the first slidable part and the second slidable part to drive the first slidable part and the second slidable part to rotate relative to the main PCB, and wherein:

the main PCB comprises a main signal line, a primary central coupling section, a first arc-shaped phase delay line, and a second arc-shaped phase delay line, wherein:

the main signal line is configured to receive an input signal and is connected to the primary central coupling section, the primary central coupling section is close to the rotating shaft and is disposed on two sides of a substrate of the main PCB, the first arc-shaped phase delay line and the second arc-shaped phase delay line are distributed on a circle with a center that is the same as a center of the rotating shaft and are located on an outer side of the primary central coupling section, the first arc-shaped phase delay line has two output ports, and the second arc-shaped phase delay line has two output ports;

the first slidable part comprises a first secondary central coupling section, a first transmission section, and a first delay line coupling section, wherein:

the first secondary central coupling section is close to the rotating shaft and is coupled to the primary central coupling section, the first delay line coupling section is connected to the first secondary central coupling section using the first transmission section, and the first delay line coupling section is coupled to the first arc-shaped phase delay line; and the second slidable part comprises a second secondary central coupling section, a second transmission section, and a second delay line coupling section, wherein:

the second secondary central coupling section is close to the rotating shaft and is coupled to the primary central coupling section, the second delay line coupling section is connected to the second secondary central coupling section using the second transmission section, and the second delay line coupling section is coupled to the second arc-shaped phase delay line.

3. The phase shifter according to claim 2, wherein at least one of the first arc-shaped phase delay line or the second arc-shaped phase delay line is a phase delay line having a superslow wave structure.

4. The phase shifter according to claim 2, wherein the phase shifter further comprises a zero phase line, and the zero phase line is connected to the main signal line and has a third output port.

5. The phase shifter according to claim 2, wherein the first slidable part is a first metal block or a first PCB, and the second slidable part is a second metal block or a second PCB.

6. The phase shifter according to claim 2, wherein the phase shifter further comprises a third arc-shaped phase delay line, and the third arc-shaped phase delay line has two output ports.

7. The phase shifter according to claim 6, wherein the first slidable part further comprises a third transmission section and a third delay line coupling section, the third delay line coupling section is connected to the first secondary central coupling section using the third transmission section, and the third delay line coupling section is coupled to the third arc-shaped phase delay line.

8. An antenna, comprising a phase shifter, wherein:

the phase shifter comprising a cavity, a rotating shaft, a main printed circuit board (PCB), a first slidable part, and a second slidable part, wherein in the cavity, the first slidable part is located on a front side of the main PCB and is coupled to the main PCB, the second slidable part is located on a rear side of the main PCB and is coupled to the main PCB, and the rotating shaft is inserted into the cavity and is connected to the first slidable part and the second slidable part to drive the first slidable part and the second slidable part to rotate relative to the main PCB, and wherein:

the main PCB comprises a main signal line, a primary central coupling section, a first arc-shaped phase delay line, and a second arc-shaped phase delay line, wherein:

the main signal line is configured to receive an input signal and is connected to the primary central coupling section, the primary central coupling section is close to the rotating shaft and is disposed on two sides of a substrate of the main PCB, the first arc-shaped phase delay line and the second arc-shaped phase delay line are distributed on a circle with a center that is the same as a center of the rotating shaft and are located on an outer side of the primary central coupling section, the first arc-shaped phase delay line has two output ports, and the second arc-shaped phase delay line has two output ports;

the first slidable part comprises a first secondary central coupling section, a first transmission section, and a first delay line coupling section, wherein:

the first secondary central coupling section is close to the rotating shaft and is coupled to the primary central coupling section, the first delay line coupling section is connected to the first secondary central coupling section using the first transmission section, and the first delay line coupling section is coupled to the first arc-shaped phase delay line; and the second slidable part comprises a second secondary central coupling section, a second transmission section, and a second delay line coupling section, wherein:

the second secondary central coupling section is close to the rotating shaft and is coupled to the primary central coupling section, the second delay line coupling section is connected to the second secondary central coupling section using the second transmission section, and the second delay line coupling section is coupled to the second arc-shaped phase delay line.

9. The antenna according to claim 8, wherein the phase shifter further comprises a third arc-shaped phase delay line, and the third arc-shaped phase delay line has two output ports.

10. The antenna according to claim 9, wherein the first slidable part further comprises a third transmission section and a third delay line coupling section, the third delay line coupling section is connected to the first secondary central coupling section using the third transmission section, and the third delay line coupling section is coupled to the third arc-shaped phase delay line.

11. The antenna according to claim 8, wherein at least one of the first arc-shaped phase delay line or the second arc-shaped phase delay line is a phase delay line having a superslow wave structure.

12. The antenna according to claim 8, wherein the first slidable part is a first metal block or a first PCB, and the second slidable part is a second metal block or a second PCB.

13. The antenna according to claim 8, wherein the phase shifter further comprises a zero phase line, and the zero phase line is connected to the main signal line and has a third output port.

* * * * *